US006264067B1

(12) United States Patent
Lasserre

(10) Patent No.: US 6,264,067 B1
(45) Date of Patent: Jul. 24, 2001

(54) DISPENSING MEMBER ACTUATING DEVICE, ASSEMBLY, AND METHOD

(75) Inventor: Pierre-André Lasserre, Coubron (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/559,639

(22) Filed: Apr. 28, 2000

(30) Foreign Application Priority Data

Apr. 29, 1999 (FR) ..... 99 05459

(51) Int. Cl.[7] ..... B67D 1/16; B67D 1/08; B67D 5/33; B67D 5/378; B65D 83/22; B05B 1/34

(52) U.S. Cl. ..... 222/108; 222/148; 222/153.11; 222/402.11; 222/571; 239/491

(58) Field of Search ..... 222/148, 402.1, 222/108, 571, 153.11, 153.13, 153.14, 394, 402.11; 239/490, 491, 492, 493, 494

(56) References Cited

U.S. PATENT DOCUMENTS

| | | | | |
|---|---|---|---|---|
| 2,894,660 | | 7/1959 | Gordon | 222/108 |
| 3,785,528 | | 1/1974 | Mandeltort | 222/148 |
| 3,913,803 | * | 10/1975 | Laauwe | 222/402.1 |
| 4,978,035 | | 12/1990 | Morane et al. | 222/108 |
| 5,021,238 | * | 6/1991 | Martino et al. | 222/394 |
| 5,100,029 | * | 3/1992 | Meshberg | 222/148 |

FOREIGN PATENT DOCUMENTS

| | | |
|---|---|---|
| 0 087 814 | 9/1983 | (EP) . |
| 2 196 949 | 3/1974 | (FR) . |
| 2 639 259 | 5/1990 | (FR) . |
| 2 677 617 | 12/1992 | (FR) . |
| 2 749 568 | 12/1997 | (FR) . |

OTHER PUBLICATIONS

English language Derwent Abstract of EP 0 087 814.
English language Derwent Abstract of FR 2 677 617.
English language Derwent Abstract of FR 2 749 568.

* cited by examiner

*Primary Examiner*—Kevin Shaver
*Assistant Examiner*—Patrick Buechner
(74) *Attorney, Agent, or Firm*—Finnegan, Henderson, Farabow, Garrett & Dunner, L.L.P.

(57) ABSTRACT

An actuation device is provided for actuating a dispensing member and for dispensing a product contained with the dispensing member. The actuation device includes an inlet orifice, a dispensing orifice, a passage, a suction orifice and a vacuum mechanism. The inlet orifice is placed in flow communication with the dispensing member. The passage extends from the inlet orifice to the dispensing orifice. The suction orifice, which is distinct from the inlet orifice, flow communicates with the passage. The vacuum mechanism includes a variable-volume chamber having a collecting region and a chamber orifice. The variable-volume chamber is entirely contained within the actuation device. The chamber orifice is in flow communication with the suction orifice. At least a portion of the collecting region is below the level of the chamber orifice. The vacuum mechanism creates a partial vacuum inside the passage so that at least some of any residual product residing in the passage is conveyed, via the suction orifice and the chamber orifice, into the collecting region of the variable-volume chamber.

37 Claims, 4 Drawing Sheets

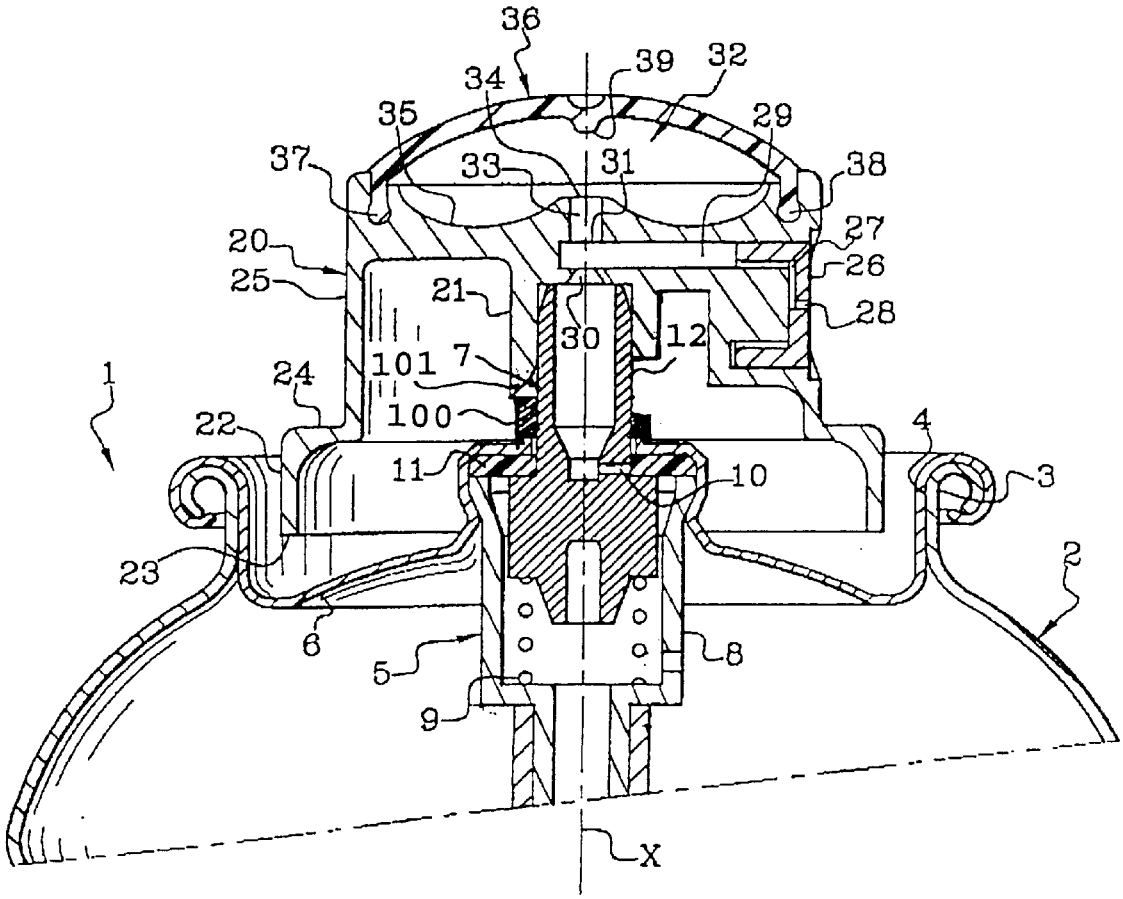
FIG. 3
FIG. 4
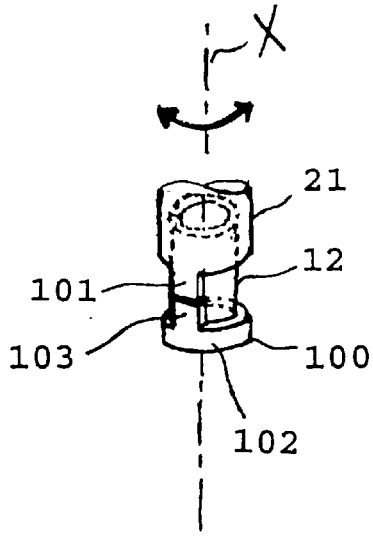

DISPENSING MEMBER ACTUATING DEVICE, ASSEMBLY, AND METHOD

The present invention relates to a device of the push-button type for actuating a dispensing member, such as a valve or pump, and dispensing a product. Preferably, the product is pressurized, for example by means of a compressed or liquefied gas.

The device according to the invention may, in its simplest form, be in the form of a push-button, for example one press-fitted onto a valve stem or pump stem. Alternatively, it may be a device of the type comprising a band for fixedly attaching the device to a container containing the product that is to be dispensed, and a part which can move with respect to the band, for example via a film hinge, so as to form a bearing surface (actuating surface) for actuating the dispensing member.

The flammability of certain volatile components, such as lacquers, which are contained in certain hair products has encouraged cosmetic research into the development of water-based lacquers. Such lacquers use compressed air or other gases, such as di-methyl ether ("DME"), as propellant.

One of the problems associated with the use of such products stems from the fact that the resins they contain, on drying, clog up the orifices, ducts or other narrow passages in the dispensing device, in particular those positioned near the dispensing orifice, thus making the device completely unusable once it has been used a few times.

FR-A-2,639,259 describes an adapter piece for dispensing product, such as a foam or mousse product. The adapter includes an elastically deformable bellows intended, when the adapter piece is mounted, to be positioned between a container containing the product and the remainder of the dispensing adapter (the adapter piece), so as to define a variable-volume chamber. In an at-rest position, the variable-volume chamber has its maximum volume. In this position, the inlet orifice of the adapter piece is not connected to the container valve stem. By exerting pressure on a bearing surface of the adapter piece, the valve stem and the inlet orifice of the adapter piece are placed in sealed communication so as to cause the product to be dispensed via a dispensing orifice connected to the inlet orifice via a duct. When the actuating pressure is released, the bellows returns to its position of maximum elongation which, on the one hand, interrupts the connection between the valve stem and the inlet orifice of the adapter piece and, on the other hand, gives rise to a partial vacuum inside the adapter piece so as to suck back any residual product residing, for example, in the duct. The sucked-back product is conveyed via the inlet orifice of the adapter piece into a cavity formed by the dished element which bears the valve of the container. A structure of this kind, in which the sucked-back product is collected in the bottom of the valve-holder dish, is also described in FR-A-2,196,949.

Although the above-mentioned design has some advantages, it also has some drawbacks. Firstly, when cleaning out the adapter piece, the adapter piece has to be disconnected from the valve stem so as to allow the sucked-back product to be able to flow into the annular region provided for this. What happens is that the residual product present in the ducts near the dispensing orifice is sucked out of these ducts via the inlet orifice of the adapter piece, that is to say via the same orifice as that via which it had entered while the valve was being actuated. What this means is that the connection has to be reestablished each time the valve is actuated again, and this is not without its problems because of the flexibility of the material which forms the connection between the adapter piece proper and the container. Furthermore, such a design is usually only capable of being used with valves of the push-in type. What is more, the adapter piece normally has to be mounted in a sealed manner on the container. Finally, such an adapter piece is of a design which is expensive to produce.

FR-A-2,677,617 describes a pump-type dispensing assembly in which, once the pump has been actuated, an overpressure is created inside the ducts near the outlet nozzle so as to expel the residual product which may otherwise stagnate at this point. A mechanism of this kind cannot work with a valve-type dispensing device. Furthermore, only some of the ducts can be cleaned out. Finally, the design is complicated and expensive.

U.S. Pat. No. 2,894,660 describes a dispensing head for toothpaste, comprising structure for causing any residual product which may remain in the ducting of the dispensing head to retreat back away from the outlet orifice of the dispensing head. The retreat of the product away from the outlet orifice is obtained by creating a partial vacuum inside a variable-volume chamber in communication with the ducting in the dispensing head. Because of its arrangement at a level substantially above an inlet orifice in communication with the ducting, this chamber cannot collect the residual product. Aside from the inability of such a chamber to collect the product, the idea that this product could be conveyed to the variable-volume chamber via an orifice of very small cross section would in any event be preposterous given the viscosity of toothpaste.

In light of the foregoing, there is a need in the art for an improved device for actuating a dispensing member.

Accordingly, one of the preferred objects of the invention is to provide an actuation device, dispensing assembly, and dispensing method which solve all or some of the problems or short-comings of the related art. Preferably, the device is capable of being mounted, for example, on a valve.

Another preferred object of the invention is to provide an actuation device equipped with a mechanism capable of allowing the ducts or other passages and narrow regions near the dispensing orifice to be cleaned out. Preferably, the device is both reliable and easy to use.

Yet another preferred object of the invention is to provide such an actuation device having an aesthetic appearance similar to that of the conventional devices and having a size that is not appreciably altered.

A further preferred object of the invention is to provide such an actuation device with an integral region for collecting the residual product. Preferably, the device is economical to produce.

A further preferred object of the invention is to provide an actuation device which optionally does not need to be attached in a sealed manner to the container for which it is intended.

It should be understood that the invention could still be practiced without performing one or more of the objects and/or advantages described above. Still other objects will become apparent from the detailed description which follows.

To achieve those and other advantages, and in accordance with the purposes of the invention, as broadly described herein, the invention includes an actuation device for actuating a dispensing member and for dispensing a product. The actuation device includes an inlet orifice, a dispensing orifice, at least one passage, a suction orifice and a vacuum mechanism. The inlet orifice is for flow communication with the dispensing member. The passage is configured to convey the product from the inlet orifice to the dispensing orifice. The suction orifice, which is distinct from the inlet orifice, flow communicates with the passage. The vacuum mechanism includes a variable-volume chamber having a collecting region and a chamber orifice. The variable-volume chamber is entirely contained within the actuation device. The chamber orifice is in flow communication with the suction orifice. At least a portion of the collecting region is below the level of the chamber orifice. The vacuum mechanism is configured to create at least a partial vacuum inside the passage so that at least some of any residual product residing in the passage is conveyed, via the suction orifice and the chamber orifice, into the collecting region of the variable-volume chamber.

For carrying out the cleaning operation, which preferably occurs after each actuation of the dispensing member, the invention preferably does not require the actuation device to be disconnected from the container on which it is mounted, thus greatly facilitating operation. Because of the relative position of the collecting region with respect to the chamber orifice of the variable-volume chamber, the risks that some of the sucked out or evacuated product might drop directly into the pump or valve stem, where it could coagulate, are greatly reduced. The actuation device according to the invention can be produced with an aesthetic appearance similar to that of conventional adapter pieces. The manual movements involved in use may also be similar to those involved for conventional adapter pieces. The actuation device according to the invention can be used with equal ease for a dispensing member configured as a pump or for a dispensing member configured as a valve. All of the ducts between the inlet orifice and the dispensing orifice preferably can be cleaned out.

In the preferred embodiment, the residual product sucked or evacuated from the passage is conveyed to a collecting region which forms an integral part of the actuation device. In other words, the collecting region is wholly defined inside the actuating device. In FR-A-2,639,259 and FR-A-2,196,949, mentioned herein above, the collecting region consists of a recessed portion formed by the dished element bearing the valve with which the container was equipped, thus meaning that the dispensing adapter piece had to be mounted in a sealed manner on the container. According to the present invention, it is preferably not necessary for the actuation device to be attached in a sealed manner to the container for which it is intended. However, the invention, in its broadest aspects, could still be practiced when such a sealed mounting is provided. The actuation device according to the invention can be used for example for actuating a valve of the push-in or tilt type. The valve may be of the male or female type.

According to one specific embodiment, the vacuum mechanism for creating a partial vacuum inside the passage comprises a movable element, for example a diaphragm, at least partially defining the variable-volume chamber, the movable element being capable, in response to sufficient pressure to cause the dispensing member to be actuated, of moving from a first position, in which the volume of the chamber is at its maximum and in which a chamber orifice of the chamber is uncovered, this orifice being connected to the suction orifice, into a second position in which the volume of the chamber is at its minimum, and in which the chamber orifice is closed off, elastic deformation stresses returning the movable element to the first position when the pressure ceases.

Preferably the movable element defines a bearing surface (actuation surface) for the actuation device. This feature contributes to keeping as simple as possible the manual operations involved in use and does not appreciably increase the size of the actuation device by comparison with conventional adapter pieces.

Advantageously, the movable element is the form of a diaphragm of an elastically deformable material, for example thermoplastic elastomer, such that the movable element elastically deforms as it moves from an unactuated position to an actuated position. Elastic stresses build up due to the deformation of the movable element from the first to the second position. These elastic stresses return the movable element to its first position, i.e., under the effect of the elasticity of the material itself, the movable element returns to the first position when the pressure ceases. A diaphragm of this kind may be mounted on the device by two-shot injection moulding, or mechanical attachment, or bonding or welding. The body of the actuation device according to the invention may be made of a rigid or semi-rigid material such as polyethylene or polypropylene. The elastically deformable diaphragm may be made of an elastomer based on such a polyolefin.

Preferably the collecting region encircles or is formed around the chamber orifice of the variable-volume chamber.

More specifically, the passage comprises a portion which, together with an outlet nozzle in which the dispensing orifice is formed, defines a chamber such as a swirl chamber. Alternatively, the device may include a diffuser member of the grating, or open-cell foam, or semi-open cell foam or frit type.

Advantageously the passage emerges, via the inlet orifice, in a portion capable of being connected permanently or temporarily to an emerging stem of the dispensing member, the partial vacuum being capable furthermore of sucking back or evacuating all or some of the residual product residing in the emerging stem, for example, after each actuation of the dispensing member.

Another aspect of the invention involves an assembly for dispensing a product, such as a cosmetic product. In particular the product may be a hair product, such as a water-based lacquer. The assembly includes a container for containing the product and a dispensing member, particularly a valve, provided on the container. The assembly further includes a dispensing member, such as one of the dispensing members described above.

When the dispensing member is a valve, the product may be pressurized by means of a propellant, particularly air or DME.

A lock-out mechanism may be provided for selectively placing the actuation device in a locked position, in which the dispensing member cannot be actuated and in which, by moving from the first position into the second, the movable element expels the product contained in the variable-volume chamber from the actuation device through the dispensing orifice. Typically, the actuation device may be mounted so that it is able to turn with respect to the container or with respect to a catching band. In a first angular position, known as the "operating" position, the actuation device may be pushed in or tilted so as to actuate the valve or the pump. In a second angular position known as the "locked" position, the actuation device finds itself against a stop, which axially or radially locks it, thus preventing any actuation of the valve or of the pump. Thus, by exerting pressure on the movable element, the product contained in the collecting region is compressed and expelled from the device via the dispensing orifice.

In a further aspect, the invention includes a method of reducing any residual product in a passage when a product is dispensed. The method includes providing the assembly according to the invention along with a product contained in the container. The dispensing member is actuated and the product is dispensed from the dispensing orifice via the passage. At least a partial vacuum is generated to convey any residual product from the passage and/or from the emerging stem to the collecting region.

Besides the structural arrangements and procedural aspects described above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a partial cross-sectional view of a dispensing assembly equipped with an actuation device according to one preferred embodiment of the invention;

FIG. 3 is a partial cross-sectional view of a dispensing assembly equipped with an actuation device according to another preferred embodiment of the invention; and FIG. 4 is a perspective view showing a detail of a lock-out mechanism as incorporated in the embodiment of FIG. 3.

Figure 1:
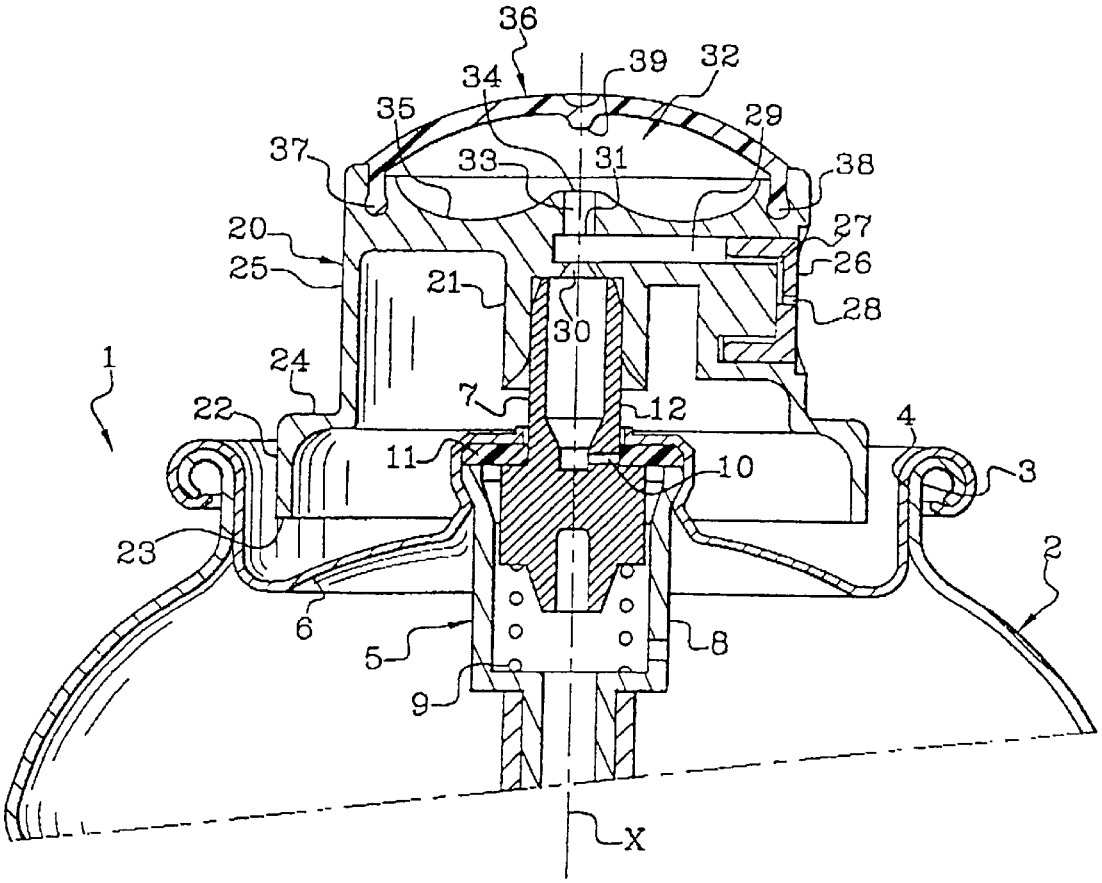

Reference will now be made in detail to the present preferred embodiments of the invention, examples of which are illustrated in the accompanying drawings. Wherever possible, the same reference numbers are used in the drawings and the description to refer to the same or like parts, and the same reference numbers with alphabetical suffixes are used to refer to similar parts.

The assembly 1 depicted in FIG. 1 comprises a container 2 (shown only in part) in the form of a can, made for example of plastic or aluminum or tin plate. The container 2 has a free edge, shaped into the form of a "roll neck" 3, defining an opening 4 in which is mounted, for example by crimping, a dispensing member 5, which is preferably a valve, mounted on a dispensing member-holder dish 6.

The dispensing member 5 is of the push-in type and comprises a hollow stem 7 emerging axially from a dispensing member body 8 inside which it can move axially. A spring 9 forces the hollow emerging stem 7 into a closed position in which an orifice 10 opening radially into the hollow emerging stem 7 bears in sealed fashion against a seal 11. The container 2, the dispensing member 5 and the actuating device which will now be described in detail, are aligned along an axis X.

A connecting adapter piece 21 of an actuation device 20 according to a preferred embodiment of the invention is preferably mounted with a tight fit on the emerging part 12 of the hollow stem 7. The actuation device 20 is shaped in the form of a push-button. It comprises a first skirt portion 22, a free edge 23 of which is located some distance from the closed end of the dispensing member-holder dish 6, so as to allow the depression movement for actuating the dispensing member 5. The skirt 22 is connected by a shoulder 24 to a skirt 25 of smaller diameter than the skirt 22.

Mounted in the skirt portion 25, particularly by snap-fastening, is a nozzle 26 defining a swirl chamber 27 and the center of the nozzle 26 includes a dispensing orifice 28. The swirl chamber 27 is in communication with a radially oriented passage 29 extending more or less as far as the axis X, so as to have one portion facing the hollow emerging stem 7.

On that side of the passage 29 which faces towards the reservoir, the passage 29 includes an axial orifice 30 forming an inlet orifice of the actuation device 20. The orifice 30 opens into the connecting sleeve 21, and communicates with the hollow emerging stem 7.

On the opposite side to the orifice 30, the passage 29 includes a second axial orifice 31, known as the "suction orifice." The suction orifice 31 is formed at one end of a duct 33, the other end of which opens to a variable-volume chamber 32 via a chamber orifice 34 of the variable-volume chamber. The variable-volume chamber 32 has a closed end 35, the center of which is raised, and in which region the chamber orifice 34 of the chamber 32 opens. Encircling the chamber orifice 34, the closed end 35 forms an annular dish. At the opposite end to the closed end 35, the variable-volume chamber 32 is closed by a thermoplastic elastomer diaphragm 36, a peripheral edge 38 of which is caught by snap-fastening in a corresponding recess 37 made near a free edge of the skirt 25 formed by the actuation device 20. In the position of rest illustrated in FIG. 1, the elastomeric diaphragm 36 forms an approximate dome, the top of which faces away from the container 2. On its face inside the variable-volume chamber 32, the elastomeric diaphragm 36 has, at its center, a pip 39 capable, when the diaphragm 36 is in the depressed position, of closing off the chamber orifice 34 of the variable-volume chamber 32 in a sealed manner.

Figure 2A:
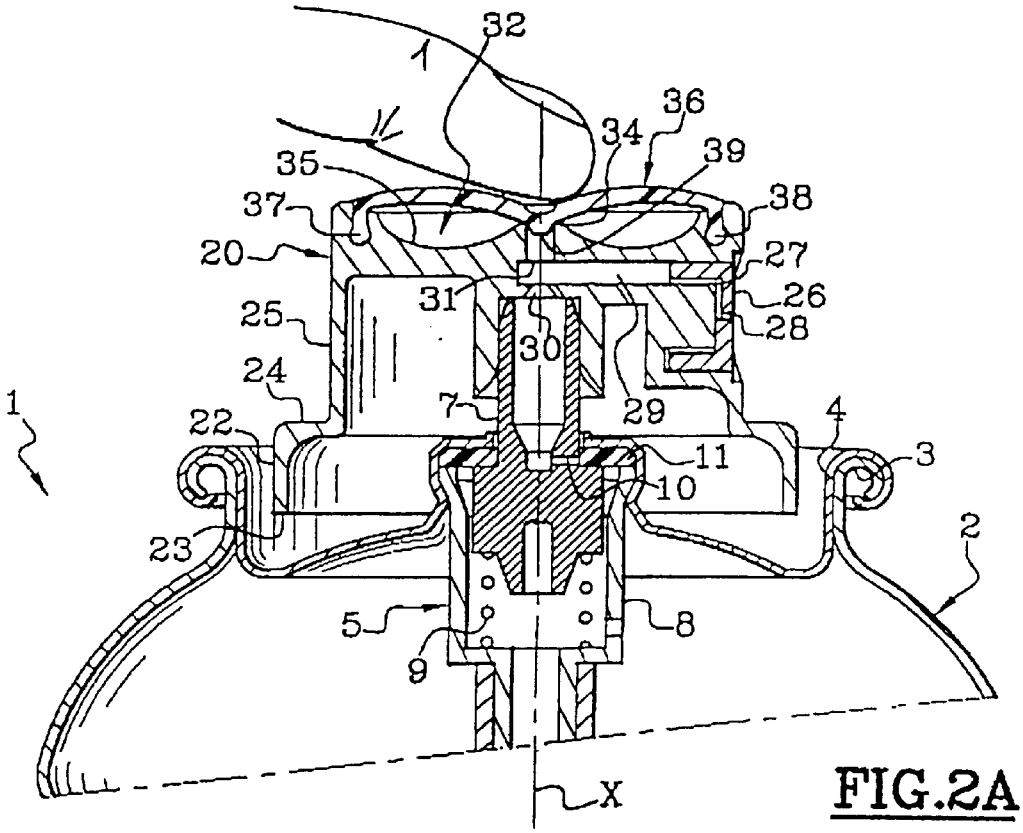
FIG. 2A is a view similar to FIG. 1 diagrammatically depicting the first stage of operation of the actuation device.

The way in which the assembly depicted in FIG. 1 works will now be described with reference to FIGS. 2A–2D. In FIG. 2A, the user is exerting axial pressure on the elastomeric diaphragm 36. The diaphragm is depressed until the pip 39 closes off the chamber orifice 34 of the variable-volume chamber 32.

Figure 2B:
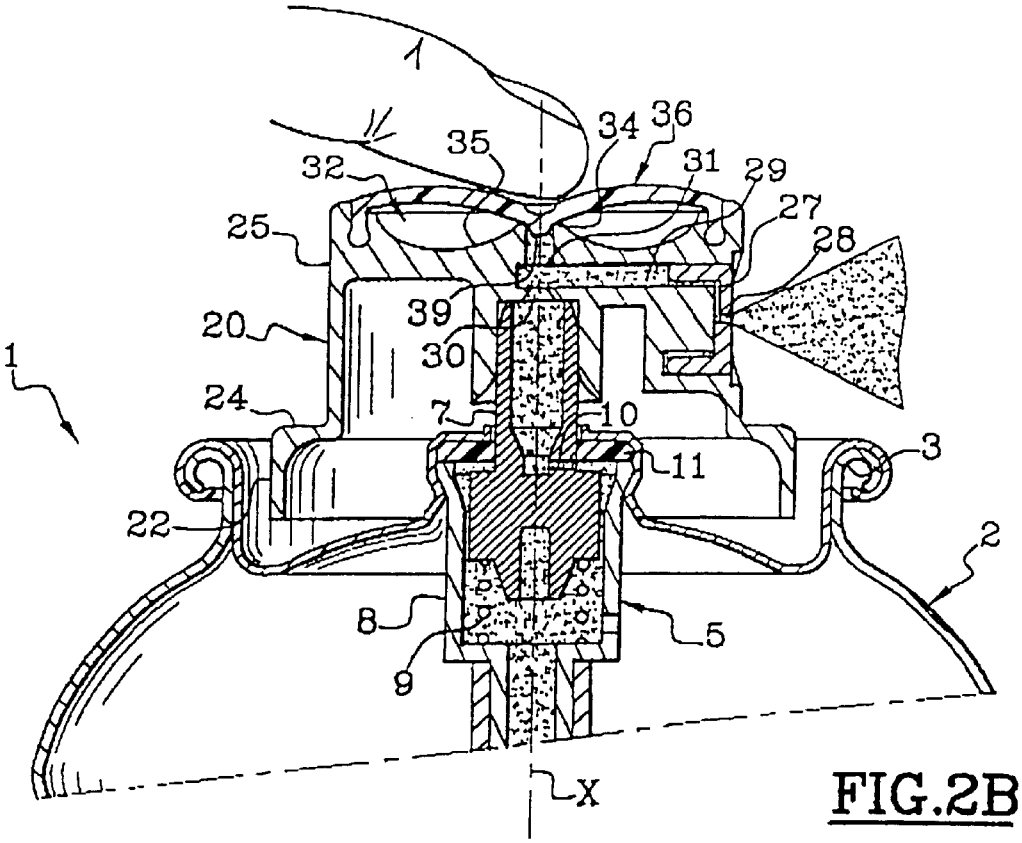
FIG. 2B is a view similar to FIG. 1 diagrammatically depicting the second stage of operation of the actuation device.
Figure 2C:
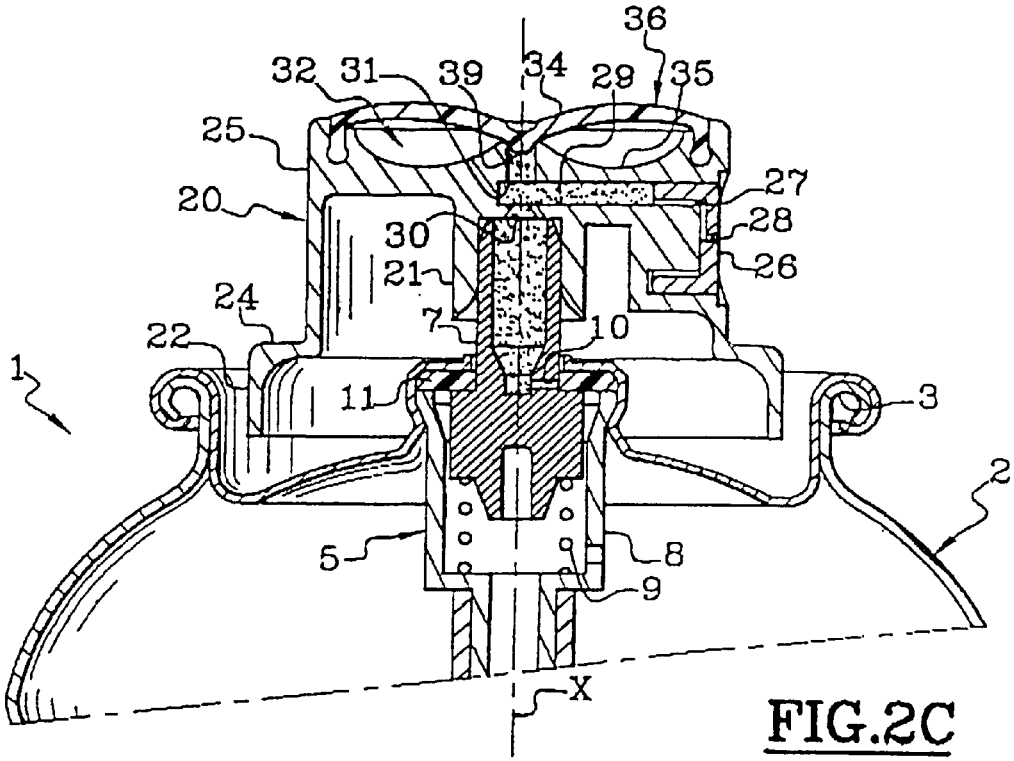
FIG. 2C is a view similar to FIG. 1 diagrammatically depicting the third stage of operation of the actuation device.

As pressure continues to be applied to the diaphragm 36, the hollow emerging stem 7 is depressed until the orifice 10 of the hollow emerging stem 7 is no longer facing the seal 11, which allows product contained inside the dispensing member body 8 to rise up inside the hollow emerging stem 7, into the passage 29 via the inlet orifice 30, pass into the swirl chamber 27 and leave, particularly in the form of a cloud of fine droplets, via the dispensing orifice 28. This dispensing position is illustrated in FIG. 2B. In this position, the product preferably cannot enter the variable-volume chamber 32 because the chamber orifice 34 of the chamber is closed off by the pip 39 formed by the interior surface of the diaphragm 36.

Once she has dispensed the desired amount of product, the user releases the pressure on the diaphragm 36. Initially (FIG. 2C), the orifice 10 of the hollow emerging stem 7 returns to the sealed position against the seal 11, which causes the dispensing member 5 to close and stops the dispensing of product. At this instant, residual product may remain in the hollow emerging stem 7 downstream of the orifice 10, and in the passage 29 which extends from the inlet orifice 30 as far as the dispensing orifice 28.

Figure 2D:
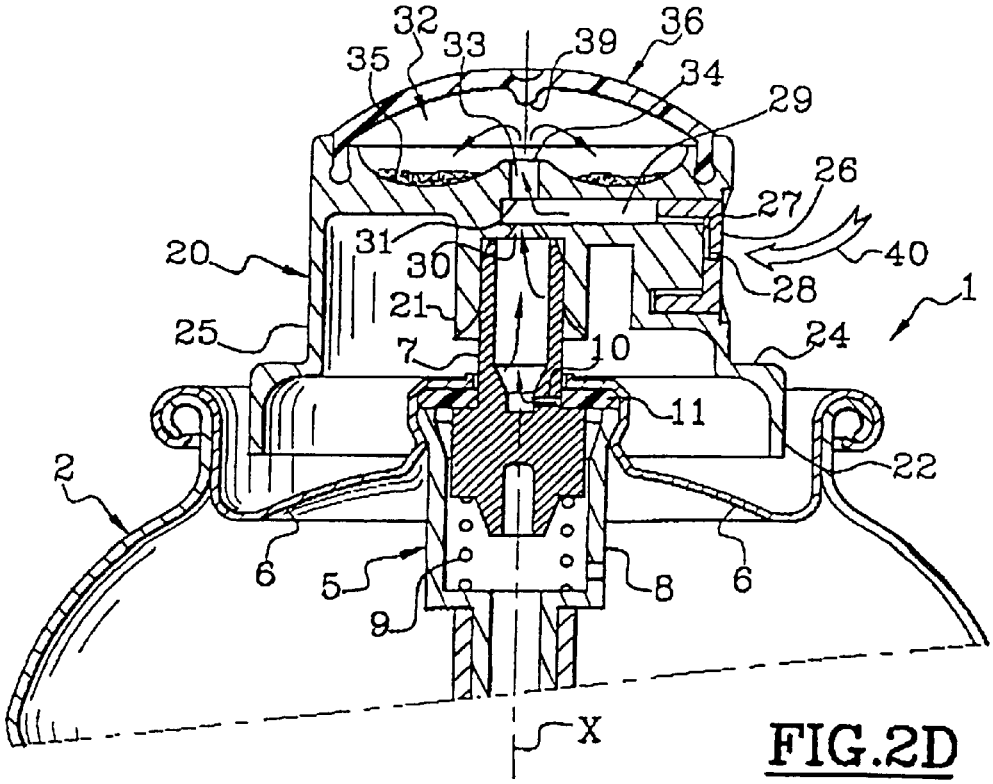
FIG. 2D is a view similar to FIG. 1 diagrammatically depicting the fourth stage of operation of the actuation device.

In the second stage, the elastic diaphragm returns to its initial dome-shaped position (see FIG. 2D). At this instant, the chamber orifice 34 of the variable-volume chamber 32 is uncovered. This uncovering action creates a partial vacuum inside the variable-volume chamber 32, which partial vacuum causes the residual product mentioned herein above to be sucked into the variable-volume chamber 32 via the suction orifice 31, the duct 33 and the chamber orifice 34 of the chamber 32. During this suction, air may be sucked in via the dispensing orifice 28, as illustrated by the arrow 40. The product thus sucked back or evacuated is deposited in the dish-shaped annular portion formed by the closed end 35 of the variable-volume chamber 32.

The volumes of residual product to be sucked back or evacuated are preferably very small. By way of indication, they are of the order of about 1 milliliter. The residual product can therefore reside in the closed end 35 of the variable-volume chamber 32. The solvents it contains may, as appropriate, escape through the material of which the elastomeric diaphragm 36 is made. A fine layer of solid resin then remains in the closed end 35 of the variable-volume chamber 32. As a preference, the collecting region formed by the closed end 35 of the variable-volume chamber 32 is dimensioned so that it can play its part effectively throughout the life of the product without the contents of the collecting region 35 having to be emptied out in the course of the emptying of the contents of the container 2.

Alternatively, it is possible to envisage cleaning out the collecting region 35, particularly after one or more uses. For this purpose, as shown in FIG. 3, the dispensing assembly may be fitted with a lock-out mechanism. The actuation device 20 may be mounted so that it can be turned with respect to a catching band or lock-out mechanism 100 via which the actuation device 20 is caught on the container 2. In a first angular position of the catching band or lock-out mechanism 100 with respect to the actuation device 20, the latter can be depressed so as to actuate the dispensing member 5. In a second angular position of the catching band or lock-out mechanism 100 with respect to the actuation device 20, the latter is against a stop which prevents the actuation device 20 from moving axially, thus preventing any actuation of the dispensing member 5. Thus, by exerting pressure on the diaphragm 36, the product contained in the collecting region 35 of the variable-volume chamber 32 is compressed by the diaphragm 36 and expelled out of the device 20 via the duct 29, the swirl chamber 27 and the dispensing orifice 28.

Referring to FIGS. 3 and 4, the lock-out mechanism 100 of the embodiment of the invention shown in FIG. 3 will now be described in more detail. A ring 102 is preferrably fixedly mounted, for example by gluing, to the dispensing member-holder dish 6. The ring 102 need not be a fully closed circle. The ring 102 has a locking tab 103 extending over a small angular portion of the ring 102 and protruding from the surface of the top edge of the ring 102. The locking tab 103 protrudes to a height at least equal to the axial movement associated with actuating the dispensing member 5. An actuation device tab 101 may be formed by an extension of the sleeve 21 of the actuation device 20. In the locked position, the actuation device tab 101 aligns with and opposes the locking tab 103 of the ring 102 so that the dispensing member 5 cannot be pushed axially downward. Therefore, in this locked position, the dispensing member 5 cannot be actuated. The actuation device 20 may be rotated, one way or the other, along with the stem 12 if the actuation device 20 is permanently mounted to the stem 12, with respect to the ring 102, until the actuation device tab 101 no longer is aligned with or opposed to the locking tab 103. With the tabs 101, 103 in this unaligned position, the actuation device 20 can be pushed axially downward and the dispensing member 5 actuated.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. An actuation device for actuating a dispensing member and for dispensing a product, said actuation device comprising:

an inlet orifice for flow communication with the dispensing member;

a dispensing orifice;

at least one passage configured to convey product from said inlet orifice to said dispensing orifice;

a suction orifice in flow communication with said passage, said suction orifice being distinct from said inlet orifice; and a vacuum mechanism including a variable-volume chamber having a collecting region and a chamber orifice for flow communication with said chamber, said variable-volume chamber being entirely enclosed within said actuation device, said chamber orifice being in flow communication with said suction orifice, and at least a portion of said collecting region being below the level of said chamber orifice, said vacuum mechanism being configured to create at least a partial vacuum inside said passage so that at least some of any residual product residing in said passage is conveyed, via said suction orifice and said chamber orifice, into said collecting region of said variable-volume chamber.

2. The actuation device of claim 1, wherein said collecting region at least substantially encircles said chamber orifice.

3. The actuation device of claim 1, wherein at least a portion of said passage defines at least a portion of a swirl chamber.

4. The actuation device of claim 1, wherein said actuation device further includes an outlet nozzle in which said dispensing orifice is formed, and at least a portion of said passage and a said outlet nozzle define a swirl chamber.

5. The device of claim 1, wherein said vacuum mechanism is configured such that at least some of any residual product residing in said passage is conveyed to said collecting region after each actuation of the dispensing member.

6. The actuation device of claim 1, wherein a portion of said device defining said inlet orifice is configured to be connected to an emerging stem of the dispensing member.

7. The actuation device of claim 6, wherein said vacuum mechanism is configured to convey into said collecting region at least some of any residual product residing in the emerging stem after each actuation of the dispensing member.

8. The actuation device of claim 1, wherein said vacuum mechanism includes a movable element at least partially defining said variable-volume chamber, said movable element being configured to move from a first position in which said variable-volume chamber has a first volume, to a second position in which said variable-volume chamber has a second volume, said first volume being greater than said second volume.

9. The actuation device of claim 8, wherein said chamber orifice is uncovered when said movable element is in said first position and said chamber orifice is closed off when said movable element is in said second position.

10. The actuation device of claim 8, wherein said movable element defines an actuation surface for said actuation device.

11. The actuation device of claim 8, wherein at least a portion of said movable element is configured to elastically deform as the movable element moves from said first position to said second position such that said movable element is capable of elastically returning to said first position.

12. The actuation device of claim 11, wherein said movable element is a diaphragm made of an elastically deformable material.

13. The actuation device of claim 12, wherein said diaphragm is mounted on said device by one of two-shot injection moulding, mechanical attachment, bonding and welding.

14. An assembly for dispensing a product, comprising:

a container for containing the product;

a dispensing member provided on said container; and an actuation device configured to actuate said dispensing member and dispense product contained within said container, said actuation device including:

an inlet orifice in flow communication with said dispensing member;

a dispensing orifice;

at least one passage configured to convey product from said inlet orifice to said dispensing orifice;

a suction orifice in flow communication with said passage, said suction orifice being distinct from said inlet orifice; and a vacuum mechanism including a variable-volume chamber having a collecting region and a chamber orifice for flow communication with said chamber, said variable-volume chamber being entirely enclosed within said actuation device, said chamber orifice being in flow communication with said suction orifice, and at least a portion of said collecting region being below the level of said chamber orifice, said vacuum mechanism being configured to create at least a partial vacuum inside said passage so that at least some of any residual product residing in said passage is conveyed, via said suction orifice and said chamber orifice, into said collecting region of said variable-volume chamber.

15. The assembly of claim 14, wherein said vacuum mechanism includes a movable element at least partially defining said variable-volume chamber, said movable element being configured to move from a first position in which said variable-volume chamber has a first volume, to a second position in which said variable-volume chamber has a second volume, said first volume being greater than said second volume.

16. The assembly of claim 14, wherein said collecting region at least substantially encircles said chamber orifice.

17. The assembly of claim 14, wherein said actuation device further includes an outlet nozzle in which said dispensing orifice is formed, and at least a portion of said passage and a said outlet nozzle define a swirl chamber.

18. The assembly of claim 14, wherein said vacuum mechanism is configured such that at least some of any residual product residing in said passage is conveyed to said collecting region after each actuation of said dispensing member.

19. The assembly of claim 14, wherein said dispensing member is a valve.

20. The assembly of claim 14, wherein said dispensing member further includes an emerging stem, and wherein a portion of said actuation device defining said inlet orifice is configured to be connected to said emerging stem.

21. The assembly of claim 20, wherein said vacuum mechanism is configured to convey into said collecting region at least some of any residual product residing in said emerging stem after each actuation of said dispensing member.

22. The assembly of claim 14, wherein said vacuum mechanism includes a movable element having a first and a second position and said assembly further includes a lock-out mechanism configured to selectively place said actuation device in a locked position in which said dispensing member cannot be actuated and in which, by moving said movable element from said first position to said second position, said vacuum mechanism expels from said actuation device via said dispensing orifice at least some of any product contained in one of said variable-volume chamber and said passage.

23. The assembly of claim 22, wherein said lock-out mechanism includes a ring mounted to said container and having a locking tab extending from the ring in a direction opposite the direction of movement of the dispensing member upon actuation of the dispensing member, said locking tab configured to oppose an actuation device tab in the locked position.

24. The assembly of claim 14, wherein the container contains a hair product.

25. The assembly of claim 24, wherein the hair product includes a water-based lacquer.

26. The assembly of claim 14, wherein the product is contained in said container and wherein the product is pressurized by a propellant.

27. The assembly of claim 26, wherein said dispensing member is a valve.

28. The assembly of claim 26, wherein the propellent includes at least one of air and DME.

29. A method of reducing any residual product residing in a passage when a product is dispensed, the method comprising:

providing the assembly of claim 14, including product contained in the container;

actuating the dispensing member;

dispensing the product from the dispensing orifice via the passage; and generating at least a partial vacuum to convey any residual product from the passage to the collecting region.

30. The method of claim 29, wherein the dispensing member includes an emerging stem, and wherein the generating of the at least partial vacuum further includes conveying to the collecting region at least some of any residual product residing in the emerging stem.

31. The method of claim 29, wherein the product contained in the container is a hair product and wherein the method further comprises applying the product dispensed from the dispensing orifice onto hair.

32. The method of claim 29, wherein the method further comprises selectively passing at least some product from the collecting region through the dispensing orifice via the passage.

33. The method of claim 29, wherein dispensing includes passing the product through a swirl chamber and thereby imparting a swirl to the product.

34. The method of claim 29, further comprising reducing the volume of the variable-volume chamber and increasing the volume of the variable-volume chamber, wherein the generating of the at least partial vacuum is caused by the increasing volume of the chamber.

35. The method of claim 29, further comprising reducing the volume of the variable-volume chamber by exerting pressure on a movable element at least partially defining the variable-volume chamber such that the movable element is moved from a first position.

36. The method of claim 35, wherein the actuating of the dispensing member includes moving the movable element into a second position, and the generating of the at least partial vacuum includes moving the movable element from the second to the first position.

37. The method of claim 36, wherein the movable element is made of an elastically deformable material and wherein the method includes elastically returning the movable element to the first position.

* * * * *

UNITED STATES PATENT AND TRADEMARK OFFICE

CERTIFICATE OF CORRECTION

PATENT NO. : 6,264,067 B1
DATED : July 24, 2001
INVENTOR(S) : Pierre-André Lasserre It is certified that error appears in the above-identified patent and that said Letters Patent is hereby corrected as shown below:

Column 10, claim 28,
Line 37, "propellent" should read -- propellant --.

Signed and Sealed this

Fourth Day of December, 2001

*Attest:*

Nicholas P. Godici

*Attesting Officer*

NICHOLAS P. GODICI
*Acting Director of the United States Patent and Trademark Office*